US006988829B2

(12) United States Patent
Bareis et al.

(10) Patent No.: US 6,988,829 B2
(45) Date of Patent: Jan. 24, 2006

(54) BAG WITH A WINDOW FOR FOODSTUFFS

(75) Inventors: Frank Bareis, Wiesbaden (DE); Juergen Schwald, Wiesbaden (DE)

(73) Assignee: BMS Papier Concept GmbH, Wiesbaden (DE)

( * ) Notice: Subject to any disclaimer, the term of this patent is extended or adjusted under 35 U.S.C. 154(b) by 0 days.

(21) Appl. No.: 10/706,310

(22) Filed: Nov. 12, 2003

(65) Prior Publication Data

US 2004/0146225 A1 Jul. 29, 2004

Related U.S. Application Data

(63) Continuation of application No. PCT/EP01/15373, filed on Dec. 31, 2001.

(30) Foreign Application Priority Data

May 14, 2001 (DE) ..... 201 08 128 U

(51) Int. Cl.
*B65D 33/01* (2006.01)

(52) U.S. Cl. ..... 383/103; 383/106; 229/87.09

(58) Field of Classification Search ..... 383/100–103, 383/106, 109, 111; 229/87.09
See application file for complete search history.

(56) References Cited

U.S. PATENT DOCUMENTS 1,770,865 A * 7/1930 Royal ..... 493/220
1,868,069 A * 7/1932 Munson ..... 383/106
2,158,755 A * 5/1939 Hodgdon et al. ..... 428/191
2,745,593 A * 5/1956 Brady ..... 383/14
3,038,651 A * 6/1962 Cloudsley ..... 383/208
5,226,735 A * 7/1993 Beliveau ..... 383/103
6,033,114 A 3/2000 Grimm et al.
6,187,396 B1 * 2/2001 Moller ..... 428/34.3

FOREIGN PATENT DOCUMENTS

| | | |
|---|---|---|
| BE | 477 473 A | 12/1947 |
| DE | 197 12 052 A1 | 9/1998 |
| FR | 1 441 107 | 6/1966 |
| WO | WO 93 22207 | 11/1993 |

* cited by examiner

*Primary Examiner*—Jes F. Pascua

(74) *Attorney, Agent, or Firm*—Martin Fleit; Paul D. Bianco; Fleit Kain Gibbons Gutman Bongini & Bianco, P.L.

(57) ABSTRACT

Bag for wrapping food items, in particular breed, rolls, and snacks, made of a composite material having at least one first layer made of a material containing cellulose and a second layer made of plastic; the first layer has a specific weight of 15 to 50 g/m$^2$, preferably from 15 to 40 g/m$^2$, and the second layer is from 6 to 20 $\mu$m thick. The composite material is perforated, and the ratio of open surface area to total surface area of the composite material is between 1/50 and 1/250, and the first layer made of material containing cellulose is interrupted in at least one area for the purpose of inclusion of a window. The window is perforated.

5 Claims, 2 Drawing Sheets

BAG WITH A WINDOW FOR FOODSTUFFS

RELATED APPLICATION

This application is a continuation of International Application PCT/EP01/15373, filed Dec. 31, 2001, the contents of which are here incorporated in their entirety.

BACKGROUND OF THE INVENTION

1. Field of the Invention

The present invention relates to a bag for wrapping food, in particular bread and similar bakery products having at least one window for observing the contents of the bag.

2. Prior Art

The purpose of food packaging is fundamentally to protect the product against drying out, loss of aroma and harmful external influences. It must also be harmless to health. In relation to the durability and freshness of bakery products such as bread, firstly the products must not dry out and secondly e.g. the crust of the bread must remain crisp.

Fresh bread and similar bakery products are usually packed by bakeries in sheets of paper or in bags of paper or plastic or a composite material thereof. With conventional packing materials so far it has not been possible to keep the bread fresh for more than two days. With paper wrappings the cut edge of the loaf becomes dry and hard after two days at the latest. In plastic wrapping however the moisture of the bread is retained but the crust absorbs the moisture and thus becomes soft and rubbery. A further disadvantage of a plastic wrapping is that is can be detrimental to the product image of a natural product such as bread.

A further requirement for packaging for bakery products such as bread, in particular for use in bakeries, is ease of handling. The bakery products must be able to be packed quickly without great complexity so that the customer can be served as efficiently as possible.

It can also be a requirement to pack bakery products, in particular bread, still warm directly after its removal from the oven. Normal packing materials, in particular of plastic, cannot be used for this as mould quickly develops when the goods packed are warm.

DE 197 12 052 C2 shows a foodstuff bag which is easy to handle while guaranteeing adequate conservation and freshness of food, in particular bakery products such as bread. The bag is made of a laminate material with at least one layer of a cellulose-containing material and a second layer of plastic, where the first layer has a specific weight of 15 to 40 g/m$^2$ and the second layer a thickness of 6 to 20 $\mu$m, where the laminate material is perforated and the ratio of open area to closed area of the laminate material is between 1/50 and 1/250.

As well as ease of handling, a particular advantage of this bag is that it can actively breathe through the perforations of the laminate material. This allows an exchange of moisture between the inside of the bag and the environment. Firstly sufficient moisture can escape from the bag that for example the crust of the bread can emit the moisture absorbed by the inside of the bread. At the same time however the amount of moisture loss is so low that even after four days a cut loaf still has enough moisture for it to remain tasty for the consumer.

The ratio of open surface to overall surface of the laminate material, e.g. the selection of hole size and number of holes per area, can establish the moisture exchange between the bag interior and the environment. Thus with a small ratio of open area to overall area of the laminate material, the moisture transfer from the bag interior to the environment is low, whereas for a large ratio the moisture transfer is greater. Thus the properties of the bag according to the invention can be adapted optimally e.g. to different bread types—loaves with a hard or soft crust, softer or harder bread. With a correspondingly selected ratio of open area to total area of the laminate material, the bag can also be used for packing bakery products still warm from the oven e.g. bread, or for packing the cooled bakery products for sale.

The combination of a cellulose-containing layer with a plastic layer not only controls the moisture emission but also ensures protection from light. The cellulose-containing layer, where it is on the outside, feels more pleasant than a plastic layer and is easy to print.

The laminate material is also sufficiently tear-resistant and despite this has a minimum mass, so that the amount of packaging waste is very small if the bags cannot be reused. This bag can be utilised not only for keeping bakery products such as bread fresh, but also for other foodstuffs such as for example cut cold meat, fresh meat or fish.

The first layer of the laminate material is preferably formed of paper or cellulose. The plastic of the second layer preferably consists of a polyethylene such as in particular an LDPE (low density polyethylene) with a density of 0.915–0.925 g/cm$^3$ or an LLDPE (linear low density polyethylene) with a density of 0.92–0.935 g/cm$^3$. Relevant criteria for selection are essentially the tear resistance and heat resistance.

The plastic layer should be resistant to temperatures up to at least 120° C., in particular for bags for bread to be packed warm from the oven or similar, so that the bread or similar can be packed as early as possible after removal from the oven.

The first and second layers can be releasably connected together so that the laminate material can largely be separated into its components. In particular this gives advantages for recycling. The layers of the laminate material can however also be firmly connected together, for example if the plastic layer is vapour-deposited onto the cellulose-containing layer.

The bag can have at least one seam in its linear direction. The seam can be formed by sealing, welding or gluing the first and/or second layers. For example by welding or sealing the adjacent plastic layers, at the seam point the first layer of cellulose-containing material lying on top can also be connected with the second layer. Thus with otherwise releasably connected layers the stability and strength of the bag are guaranteed.

The laminate material lying overlapping at the base of the bag is preferably joined with a double fold. The first layers of the composite material lying folded an each other can then be glued together giving a firm connection, in particular with an otherwise separable laminate material.

For the bag known from DE 197 12 052 C2 perforations are preferred formed as holes with a mean diameter of 0.3 mm to 1.5 mm, preferably 1 mm. With this hole size effective protection of the food is guaranteed against light influences and soiling with simultaneous moisture exchange.

SUMMARY OF THE INVENTION

Taking the bag known from DE 197 12 052 C2 as a starting point the present invention aims to provide an improved bag for wrapping food items.

This problem is solved by the invention by means of a bag for wrapping food items, in particular breed, rolls, and snacks, made of a composite material having at least once first layer made of a material containing cellulose and a second layer made of plastic; the first layer has a specific weight of 15 to 50 g/m$^2$, preferably from 15 to 40 g/m$^2$, and the second layer is from 6 to 20 $\mu$m thick the composite material is perforated, and the ratio of open surface area to total surface area of the composite material is between 1/50 and 1/250, and the first layer made of material containing cellulose is interrupted in at least one area for the purpose of inclusion of a window; the said window is perforated, and the said window covers between ⅓ and ½ of the total surface area of the bag. Preferred embodiments of the invention include a bag in accordance with the above characterized in that the window area essentially has the shape of a square, circle, ellipsoid, or strip; a bag in accordance with the above characterized in that the area is located essentially in the middle of the bag; and wherein the window area is located on at least one of the sides of the bag.

The invention provides a bag for wrapping food items, in particular bread, made of a composite material and having one or more windows. The first layer of the laminate material has one or more interruptions. The wall of the bag is constituted by the second layer of plastic of the laminate material where the layer of cellulose-containing material is interrupted. The second layer of plastic of the composite material can be transparent, perforated, or non-perforated.

This enables a positive presentation of the food item wrapped in the bag as it is possible to look at the food item through the one or more windows that are formed in the composite material. This advantage is of particular importance for selling of food items in a self service area or for the presentation of food items at points of sales.

Surprisingly the interruption of the first cellulose-containing layer of the composite material does not substantially impact the conservation capability of the bag in accordance with the present invention, in particular if the size of the interruption does not surpass about one half, preferably one third, of the bag surface. This enables to combine the conservation capability and the presentation of the food item wrapped in the bag for the purpose of sales promotion.

Thus the second layer of plastic of the composite material alone constitutes the wall of the bag where the first layer of cellulose-containing material of the composite material is interrupted. In this area of the bag the second layer of plastic of the composite material can be perforated or non-perforated which surprisingly does not substantially impact the conservation capability of the bag of the invention, as long as the size of the interruption is not substantially above one half, preferably one third, of the bag surface. Preferably the second layer is also perforated in the area where the first layer is interrupted.

The one or more windows can be realised by interrupting of the first cellulose-containing material at arbitrary areas of the bag.

In accordance with a preferred embodiment of the invention a window is formed at a middle area of the bag. This area can be rectangular or it can extend over the entire length of the bag. This embodiment is particularly advantageous for packaging of bread loaves, as bags with the bread loaves are positioned horizontally or oblique in the shelf, such that the consumer can see the bread loaf that is packaged in the bag.

In accordance with a further preferred embodiment of the invention the layer of cellulose-containing material is interrupted in at least a side area of the bag. This embodiment is particularly advantageous for the sales of sandwiches, baguette-sandwiches and similar products, as the filling of the sandwich or baguette-sandwich can be seen through the interruption of the layer of cellulose-containing material which promotes sales. Nevertheless the conservation effect of the bag remains.

BRIEF DESCRIPTION OF THE DRAWING

The subject matter of the invention is explained in greater detail by means of a preferred embodiment making reference to FIG. 1, of the drawing, which shows an embodiment of the novel bag in accordance with the present invention.

DETAILED DESCRIPTION OF PREFERRED EMBODIMENTS OF THE INVENTION

Bag 1 consists of composite material. The composite material consists of an outer layer of cellulose with a density of approx. 30 g/m$^2$, and an inner about 8 $\mu$m thick layer of LDPE.

In the production of such a composite material the LDPE layer is applied to the cellulose layer e.g. directly from a blister film extruder and attached to the cellulose layer by localised pressure of the extruded LDPE layer during coating.

The bag consists of a rectangular sheet of composite material with multiple folds which is folded several times in the linear direction so that the LDPE layer forms the inner layer of the bag. The inner LDPE layer is heat-sealed at the adjacent free ends of the bag in the linear direction so that the bag has a seam in the linear direction. The seal firmly connects the cellulose layer in the area of the seam to the LDPE layer below. The overlapping composite material at the base of the bag is joined in a double fold and the outsides of the composite material overlapping due to the fold are for example glued together.

The bag has e.g. regular perforations formed by holes with diameters of around 1 mm, spaced around 15 mm apart and arranged in different parallel rows, where the rows are spaced around 15 mm apart. The ratio of open to overall area is taken from $$N*\pi*(d/2)^3/A$$

(N=number of holes; d=average diameter of holes; A=reference surface) as $2*\pi*(1\ \text{mm}/2)^2/(15\ \text{mm})^2=\pi/450=1/150$.

Preferably the bag is produced by means of an inline-method. The perforation is applied with a needle roller either to the composite material before processing into the bag or directly to the bag made of the composite material during rolling.

A tubular bag can be produced by cutting out one layer of composite material and one layer of composite material having an interrupted first layer. The layers are positioned on top of each other and are welded together along three outer edges. Due to the interruption of the first layer in one of the layers of composite material a window is formed in the bag. Alternatively one of the layers consists of composite material and the other layer consists only of the second layer. In this instance a bag is obtained having a window that covers one half of the total surface area of the bag.

Bag 1 has a stripe-like interruption in its middle area 2 of its outer layer of cellulose, such that the wall of the bag is constituted in area 2 only by the LDPE-layer. As the LDPE-layer is transparent area 2 constitutes a window. The interruption of the cellulose layer can be realised in the production of the composite material by a corresponding selection of the width of the cellulose-and LDPE-layers that are glued together.

Figure 1:
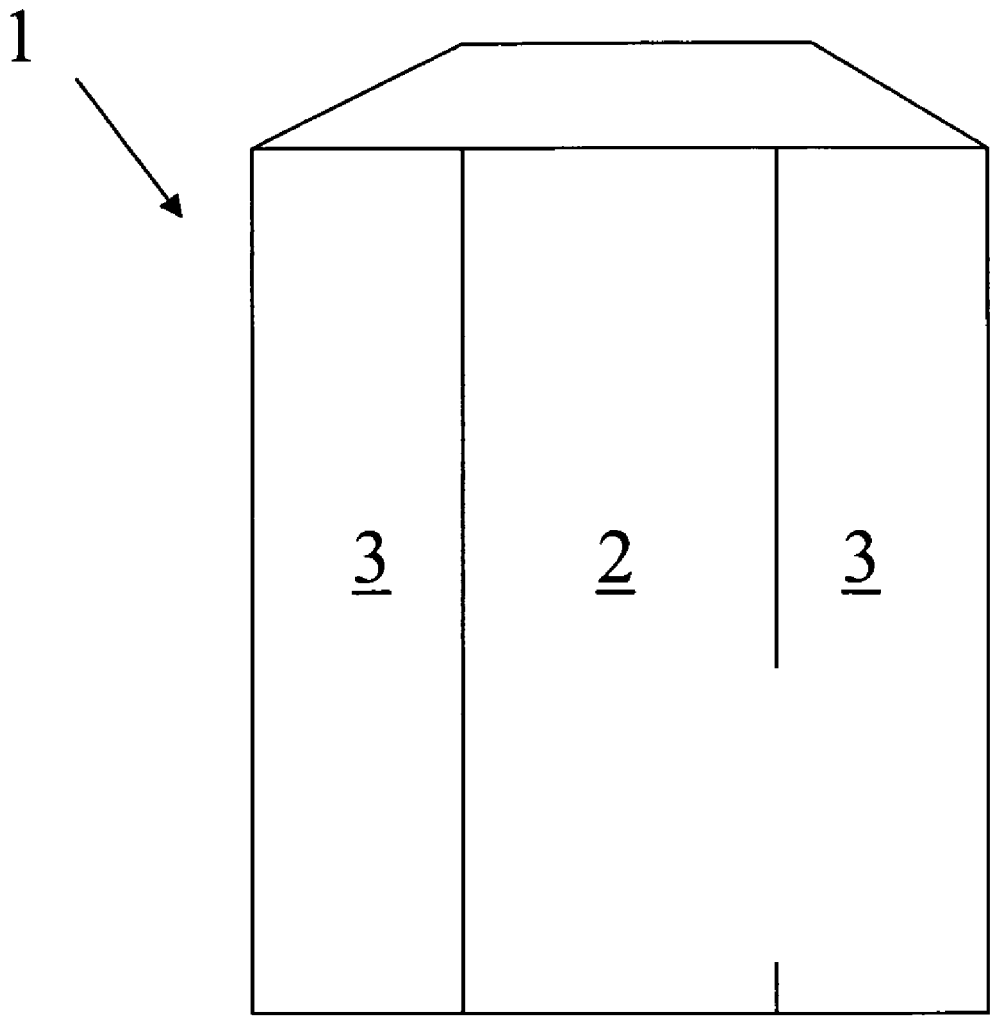
Figure 2A:
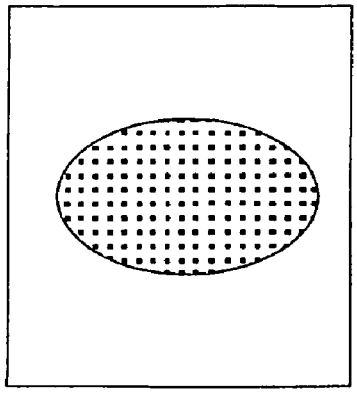
FIGS. 2A to 2C show respectively, oval, square and circular windows in the novel bag.
Figure 2B:
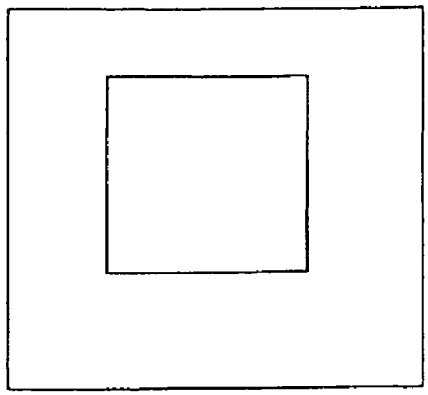
Figure 2C:
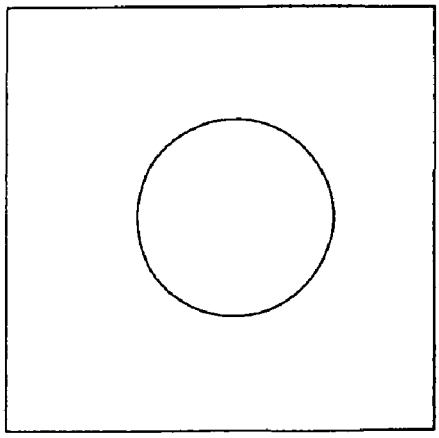

Alternatively or in addition the outer layer of cellulose can be interrupted in one or more side areas 3 in order to provide side windows on bag 1. As shown in FIGS. 2A to 2C, respectively, an oval window 5, a square window 7 and a circular window 9 is provided in a side of the bag 1.

What is claimed is:

1. Bag for wrapping food items, in particular bread, rolls, and snacks, made of a composite material having at least one first layer made of a material containing cellulose and a second layer made of plastic; the first layer having a specific weight of 15 to 50 g/m$^2$, and the second layer being from 6 to 20 $\mu$m thick, the composite material being perforated, and the ratio of open surface area to total surface area of the composite material is between 1/50 and 1/250, and the first layer made of material containing cellulose being interrupted in at least one area of the bag for the purpose of inclusion of a window; the said window being perforated, and the said window covering between ⅓ and ½ of the total surface of said area of the bag including the window.

2. Bag in accordance with claim 1 wherein the first layer has a specific weight of from 15 to 40 g/m$^2$.

3. Bag in accordance with claim 1 wherein the at least one area of the bag is a side of the bag and the window essentially has the shape of one of a square, circle, ellipsoid, and strip.

4. Bag in accordance with claim 1 wherein the at least one area of the bag is a side of the bag and the window is located essentially in the middle of said side of the bag.

5. Bag in accordance with claim 1 wherein the at least one area of the bag is a side of the bag and the window is located adjacent to one edge of said side of the bag.

* * * * *